US005964099A

United States Patent [19]

Kim

[11] Patent Number: 5,964,099

[45] Date of Patent: Oct. 12, 1999

[54] AIR CONDITIONER COOLANT CIRCULATION ROUTE CHANGING APPARATUS

[75] Inventor: Jae-Soon Kim, Suwon, Rep. of Korea

[73] Assignee: Samsung Electronics Co., Ltd., Suwon, Rep. of Korea

[21] Appl. No.: 08/976,726

[22] Filed: Nov. 24, 1997

[30] Foreign Application Priority Data

May 20, 1997 [KR] Rep. of Korea ..... P97-19611

[51] Int. Cl.[6] ..... F25B 13/00

[52] U.S. Cl. ..... 62/324.6

[58] Field of Search ..... 62/324.1, 324.6, 62/325, 528

[56] References Cited

U.S. PATENT DOCUMENTS

| | | | |
|---|---|---|---|
| 3,977,210 | 8/1976 | Bruguier | 62/324.6 |
| 4,306,422 | 12/1981 | Korycki | 62/324.6 |
| 4,825,664 | 5/1989 | Vandervaart | 62/324.1 |
| 5,165,254 | 11/1992 | Kountz et al. | 62/324.6 |

*Primary Examiner*—William Doerrler
*Attorney, Agent, or Firm*—Burns, Doane, Swecker & Mathis, L.L.P.

[57] ABSTRACT

An air conditioner coolant circulation route changing apparatus for improving efficiency of the heating operation during the heating operation and to prevent efficiency of its cooling operation from being deteriorated in case the heating operation is changed into the cooling operation, the air conditioner having dual functions of heating and cooling operations provided with a compressor for compressing a coolant into the coolant of high temperature and high pressure, an outdoor heat-exchanger for condensing the coolant of the compressor, a cooling capillary tube for expanding the condensed coolant at the outdoor heat-exchanger, an indoor heat-exchanger for changing the coolant into a perfect gas coolant of low temperature and low pressure and for getting heat-exchanged with the air flown into the room, the apparatus which changes the coolant circulation direction of the coolant flowing inside of the indoor heat-exchanger, regardless of heating or cooling operation, from inside of the indoor unit to the room air suction side, that is, the reverse direction to that of the air flowing into the indoor unit.

1 Claim, 4 Drawing Sheets

AIR CONDITIONER COOLANT CIRCULATION ROUTE CHANGING APPARATUS

BACKGROUND OF THE INVENTION

1. Field of the Invention

The present invention relates to an air conditioner and more particularly to an air conditioner coolant circulation route changing apparatus by which efficiency is substantially improved for cooling and heating operations.

2. Description of the Prior Art

A conventional air conditioner is classified into a variety of types according to its functions and composition of its units. The air conditioner is classified into an exclusive cooling use, an exclusive cooling and dehumidifying use, a dual function of cooling cum heating operations according to its functions, while being classified into an integral type having integrated functions of cooling and heating operations and being installed on a window and a separate type having a cooling apparatus disposed at a room, a heating apparatus and a compressor placed at the outside of the room according to the composition of its units.

In the aforementioned air conditioner of a dually functioned heating cum cooling operations, an indoor unit (10) installed in the room and an outdoor unit (20) may be operated as an integral system, as necessary, for the heating or cooling operation.

The separate type of air conditioner is made up of the indoor unit (10) and the outdoor unit (20) as illustrated in FIGS. 1 and 2. The outdoor unit (20) includes a compressor (30) for compressing a coolant into that of high temperature and high pressure, an outdoor heat-exchanger (40) for heat-exchanging the compressed coolant of high temperature and high pressure with outdoor air by way of cooling and condensation, a cooling capillary tube (50) and a heating capillary tube (51) for passing and expanding the coolant of room temperature and high pressure cooled and condensed at the outdoor heat-exchanger (40) into the coolant of low temperature and low pressure. On the other hand, the indoor unit (10) includes an indoor heat-exchanger (60) for changing the coolant passed through the cooling capillary tube (50) into gaseous coolant of low temperature and low pressure in vaporization, thereby heat-exchanging with the room air at the indoor heat-exchanger (60).

At one side of the compressor (30) is a four way valve (70) of an applied electronic valve for changing the circulation routes of the coolant, where the compressed coolant of high temperature and high pressure from the compressor (30) flows into the outdoor heat-exchanger (40) for the cooling operation, and into the indoor heat-exchanger (60) for the heating operation.

In the air conditioner, the cooling cycle is depicted by solid arrows in FIG. 1 for the cooling operation, where the gaseous coolant of high temperature and high pressure discharged from the compressor (30) of the outdoor unit (20) is passed through the four way valve (70), cooled and condensed at the outdoor heat-exchanger (40), thereby being heat-exchanged with the outdoor air. The liquid coolant of room temperature and high pressure passed through the outdoor heat-exchanger (40) is infused into the cooling capillary tube (50), changed into a coolant of low temperature and low pressure in expansion heat-exchanged cooled and infused into the indoor heat-exchanger (60) inside of the indoor unit (10).

The liquid coolant is vaporized at the indoor heat-exchanger (60), thereby changing into a perfect gas coolant of low temperature and low pressure. Then, the gaseous coolant at the indoor heat-exchanger (60) is heat-exchanged with the room air, thereby cooling the room at low temperature.

Accordingly, the gaseous coolant of low temperature and low pressure is infused into the compressor (30) and changed into a gaseous coolant of high temperature and high pressure by way of the heat insulation and compression reactions. Therefore, the cooling cycle is to be repeated as described above.

On the other hand, the heating cycle is carried out in the dotted arrow direction in FIG. 1 for the heating operation, where the coolant is circulated to heat the room at an opposite direction to that for the cooling operation.

However, in the air conditioner described above, as illustrated in FIG. 2, the indoor heat-exchanger (60), used as a vaporizer during the cooling operation and as a condenser during the heating operation, is designed to let the coolant flow at the straight arrow direction during the cooling operation, from its outlet (62) to its inlet (61). The air flowing into the indoor unit (10) flows from a room air suction side (O) toward inside of the indoor unit (I). At that time, the temperature of the coolant inside of the indoor unit (I), close to the inlet (61), at A part shown in the drawings, is lower than the temperature of the coolant at the room air suction side (O), close to the outlet (62) of the indoor heat-exchanger (60).

The coolant is circulated in a reverse direction, i.e., in the dotted arrow direction during the heating operation, enabling the coolant to flow from the inlet (61) of the indoor heat-exchanger (60) to its outlet (62), where the cold air in the room flows from the room air suction inlet (O) to the indoor unit (I). At that time, the temperature of the coolant at the A part in the drawings is lower than the temperature of the coolant at the room air suction side (O). Due to the aforementioned reasons, there are problems in the conventional air conditioner in that the efficiency of the heating operation is substantially deteriorating and same is applied to the cooling operation when the heating operation is changed into the cooling operation.

SUMMARY OF THE INVENTION

The present invention is presented to solve the aforementioned problems and it is an object of the present invention to provide an air conditioner which improves efficiency of its heating operation during the heating operation and prevents efficiency of its cooling operation from being deteriorated in case the heating operation is changed into the cooling operation.

In order to achieve the object of the present invention, a coolant circulation route changing apparatus of an air conditioner having dual functions of heating and cooling operations provided with a compressor for compressing a coolant into the coolant of high temperature and high pressure, an outdoor heat-exchanger for condensing the coolant of the compressor, a cooling capillary tube for expanding the condensed coolant at the outdoor heat-exchanger, an indoor heat-exchanger for changing the coolant into a perfect gas coolant of low temperature and low pressure and for heat-exchanging it with the air flown into the room, the apparatus for changing the coolant circulation direction of the coolant flowing inside of the indoor heat-exchanger, regardless of heating or cooling operation, from inside of the indoor unit to the room air suction side, that is, the reverse direction to that of the air flowing into the indoor unit.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
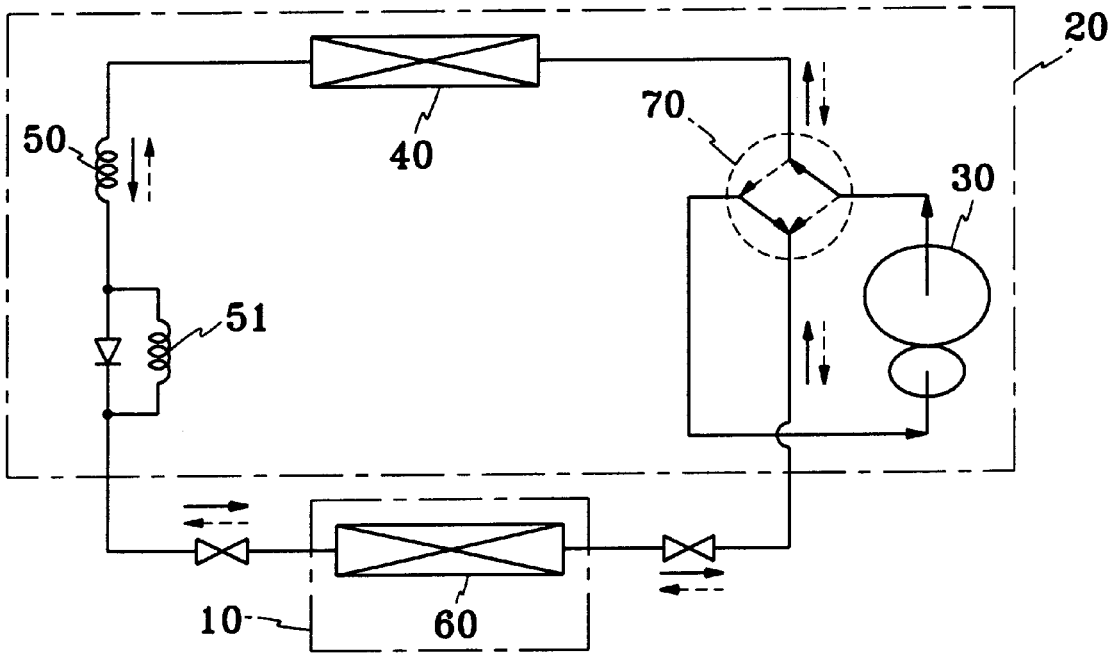
FIG. 1 (Prior Art)
FIG. 1 is a coolant circulation cycle of a conventional air conditioner for heating cum cooling operations.
Figure 2:
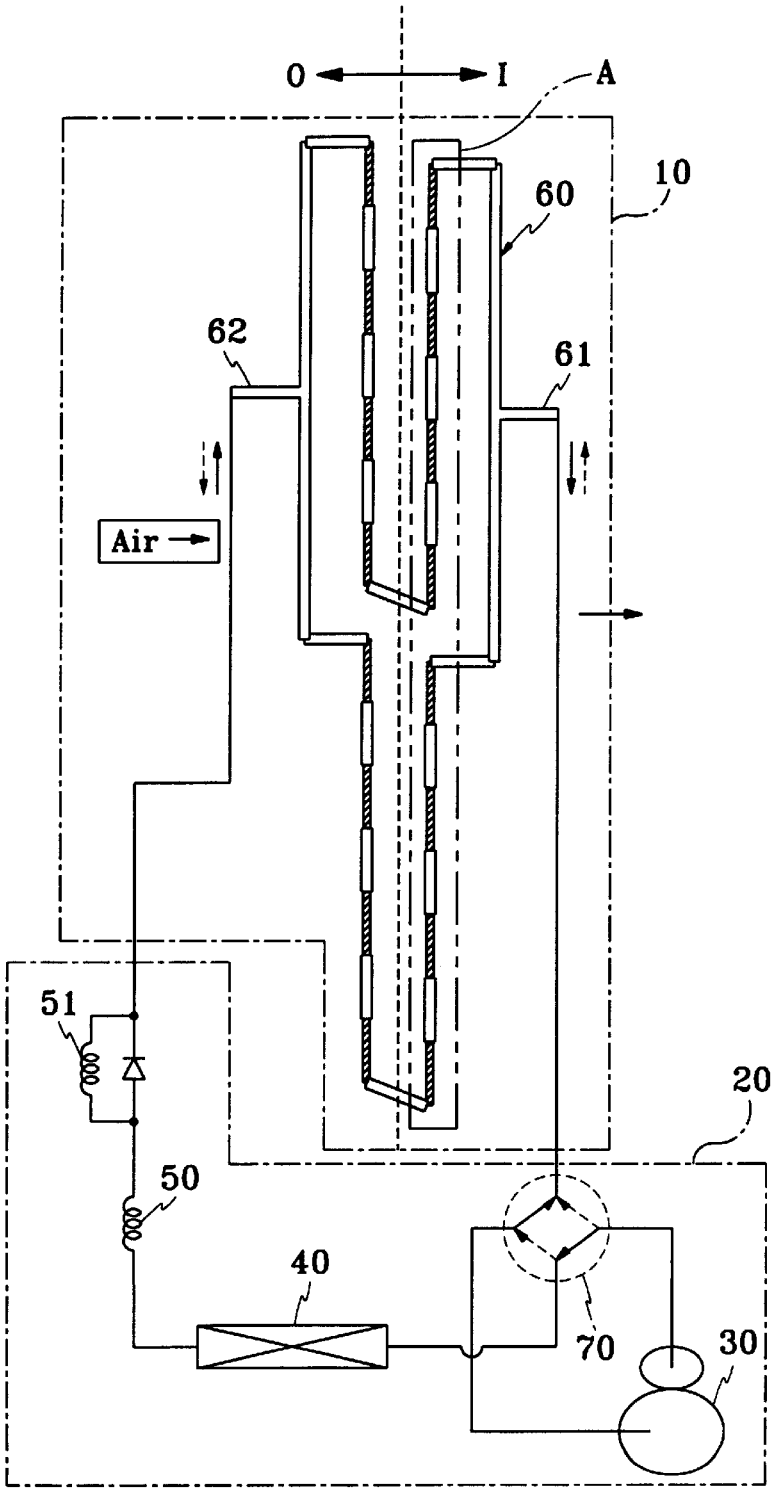
FIG. 2 (Prior Art)
FIG. 2 is a coolant circulation route for illustrating in detail circulation of a coolant circulated into a conventional indoor heat-exchanger.

The present invention is described in detail with reference to the accompanying drawings. Throughout the drawings, like reference numerals and symbols are used for designation of like or equivalent parts or portions for simplicity of illustration and explanation, and redundant references will be omitted.

Figure 3:
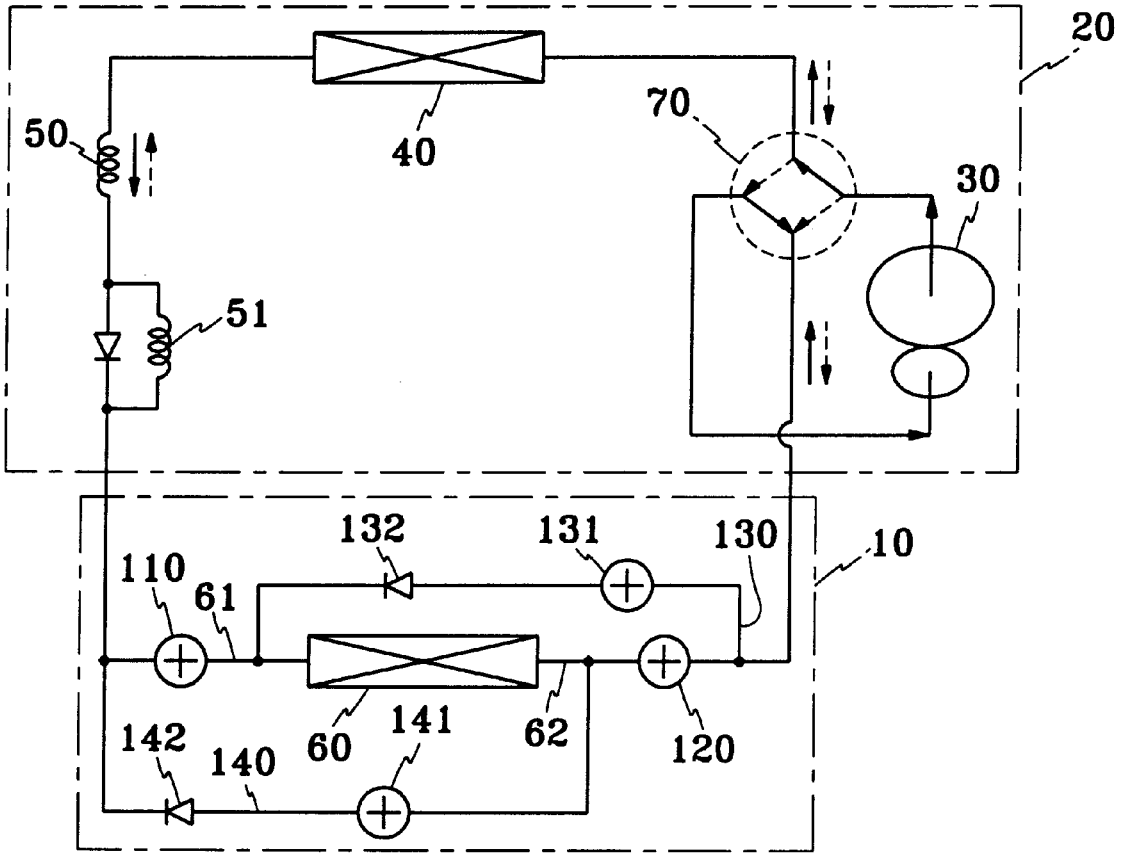
FIG. 3 is a coolant circulation cycle of an air conditioner for heating cum cooling operations in accordance with the present invention.
Figure 4:
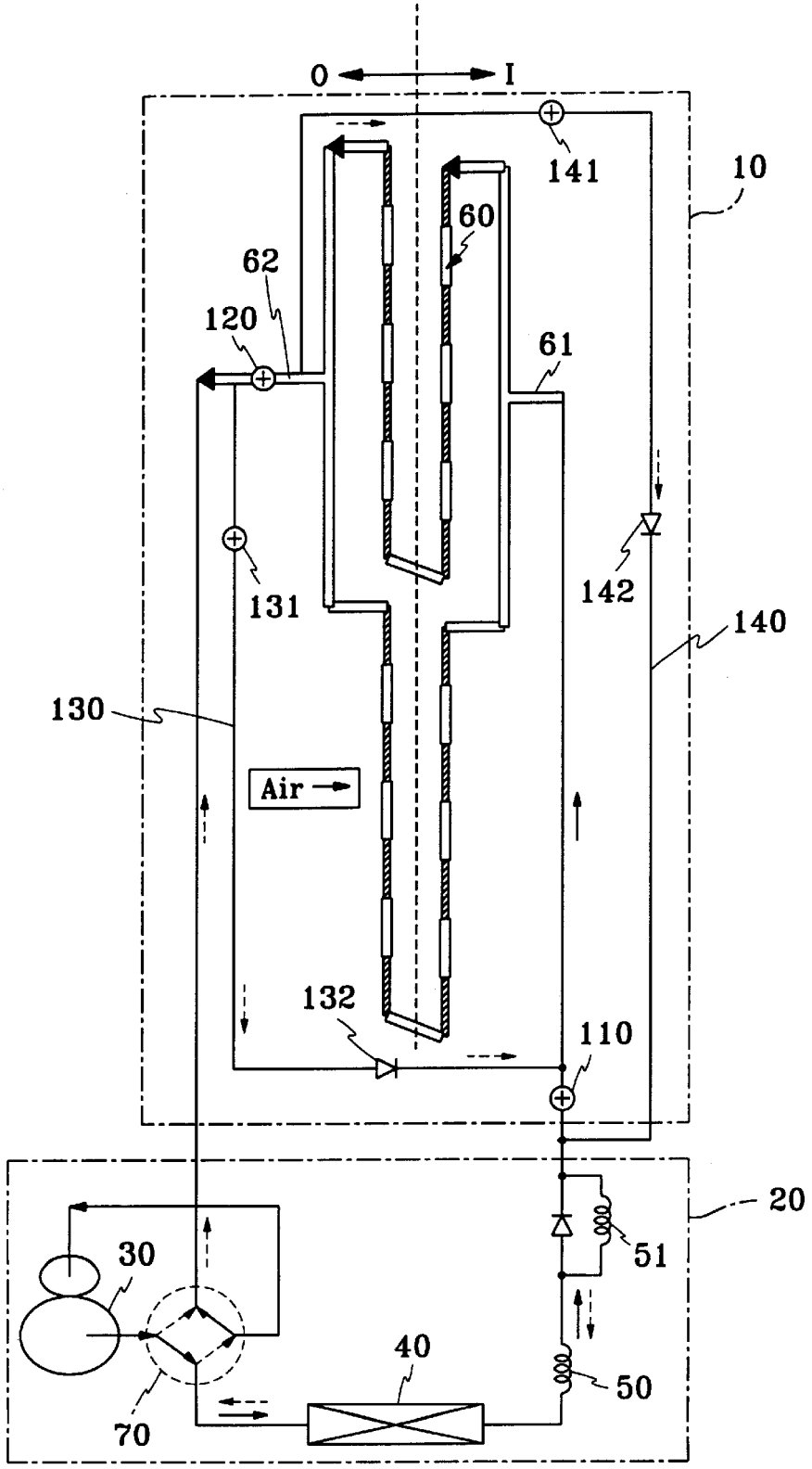
FIG. 4 is a coolant circulation route for illustrating in detail circulation of a coolant circulated into an indoor heat-exchanger according to the present invention.

As shown in FIGS. 3 and 4, for the cooling operation cycle an air conditioner is provided with a compressor (30) for compressing a coolant into the coolant of high temperature and high pressure, an outdoor heat-exchanger (40) for condensing the coolant of the compressor, a cooling capillary tube (50) for expanding the condensed coolant at the outdoor heat-exchanger, and an indoor heat-exchanger (60) for changing the coolant into a perfect gas coolant of low temperature and low pressure and for heat-exchanging it with the air flown into the room. A first conduit 10A connects the capillary tube 51 with the inlet 61 of the indoor heat exchanger. A second conduit 10B connects the outlet 62 of the indoor heat exchanger with the compressor 30 via the four-way valve 70.

There is also provided at the side of an inlet (61) and outlet (62) of the indoor heat-exchanger (60) a coolant circulation route changing apparatus which changes the coolant circulation direction of the coolant flowing inside of the indoor heat-exchanger, regardless of heating or cooling operation, from inside of the indoor unit (I) to the room air suction side (O), that is, the opposite direction to that of the air flowing into the indoor unit.

The coolant circulation route changing apparatus comprises:

- a first solenoid valve (110), which is opened during the cooling operation and which is closed during the heating operation, being disposed at the inlet (61) of the indoor heat-exchanger (60);
- a second solenoid valve (120) which is opened during the cooling operation and which is closed during the heating operation, being at the outlet (62) of the indoor heat-exchanger (60);
- a first coolant tube (130) with the one end being connected between the indoor heat-exchanger (60) and the first solenoid valve (110) and the other end thereof connected to the external side of the second solenoid valve (120) at the outlet (62) of the indoor heat-exchanger (60); and
- a second coolant tube (140) with the one end thereof being connected between the indoor heat-exchanger (60) and the other thereof being connected to the external side of the first solenoid valve (120) at the inlet (61) of the indoor heat-exchanger (60).

The first coolant tube (130) includes:

- a third solenoid valve (131) which is opened to draw the flowing direction of the coolant into the inlet (61) of the indoor heat-exchanger (60) as the first and the second solenoid valves (110 and 120) are closed during the heating operation; and
- a first checking valve (132) installed at one side of the third solenoid valve (131) to prohibit the coolant passed through the third solenoid valve (131) from flowing in the reverse way.

The second coolant tube (140) includes:

- a fourth solenoid valve (141) which is opened to enable the coolant passed from the inlet (61) of the indoor heat-exchanger (60) to its coolant outlet (62) to be flown into the heating capillary tube (51) as the first and second solenoid valves (110 and 120) are closed during the heating operation; and
- a second checking valve disposed at the one side of the fourth solenoid valve (141) to refrain the coolant passed through the fourth solenoid valve (141) from flowing in the reverse way. In other words, the third and fourth solenoid valves (131 and 141) are closed during the cooling operation.

Next, the operational effect of the present invention is described in detail below. When the cooling cycle is formed in the solid arrow direction for the cooling operation, the coolant of high temperature and high pressure discharged from the compressor (30) of the outdoor unit (20) is passed through the four way valve (70), cooled, condensed and heat-exchanged with outdoor air in the outdoor heat-exchanger (40), whereby the liquid coolant of room temperature and high pressure passed through the outdoor heat-exchanger (40) is infused into the cooling capillary tube (50).

The liquid coolant of room temperature and high pressure infused into the cooling capillary tube (50) is changed into the coolant of low temperature and low pressure in expansion and infused into the indoor heat-exchanger (60) through the first solenoid valve (110) opened at the inlet (61) of the indoor heat-exchanger (60) in the indoor unit (10). The liquid coolant is changed into a perfect gas coolant of low temperature and low pressure in vaporization to get heat-exchanged with the room air for cooling the room.

In addition, the gaseous coolant of low temperature and low pressure is infused into the compressor (30) through the outlet (62) of the indoor heat-exchanger (60) and changed into the gaseous coolant of high temperature and high pressure by way of the heat insulation and compression reactions of the compressor (30) for repeating the cooling cycle. At that time, the third and fourth solenoid valves (131 and 141) are kept closed to prohibit the coolant from flowing into the first and second coolant tubes (130 and 140).

On the other hand, when the heating cycle is formed in the dotted arrow direction, the gaseous coolant of high temperature and high pressure is discharged from the compressor (30), passed through the four way valve (70), the third solenoid valve (131) and the first checking valve (132) of the first coolant tube (130) and flows from the inlet (61) of the indoor heat-exchanger (60) to its outlet (62), to thereby being condensed with heat emission which enables room air to get heat-exchanged. The liquid coolant of room temperature and high pressure passed through the indoor heat-exchanger (60) is infused through its outlet (62), the fourth solenoid valve (141) and the second checking valve (142) of the second coolant tube (140) into the heating capillary tube (51), to thereby repeat heating operation.

Apparent from the foregoing, there is an advantage in the air conditioner of the present invention in that as a coolant circulation route changing apparatus is provided to change the coolant circulation direction of the coolant flowing inside of the indoor heat-exchanger, regardless of heating or cooling operation, from inside of the indoor unit to the room air suction side, that is, the reverse direction to that of the air flowing into the indoor unit, to thereby improve efficiency of its heating operation during the heating operation and prevents efficiency of its cooling operation from being deteriorated in case the heating operation is changed into the cooling operation.

What is claimed is:

1. An air conditioner having dual functions of heating and cooling and including a compressor for compressing a coolant into a coolant of high temperature and high pressure, an outdoor heat-exchanger for condensing the coolant of the compressor, a cooling capillary tube for expanding the condensed coolant at the outdoor heat-exchanger, an indoor heat-exchanger having a coolant inlet and a coolant outlet for changing the coolant into a perfect gas coolant of low temperature and low pressure and for heat-exchanging the coolant with room air and a coolant conducting arrangement for changing the coolant circulation direction of the coolant flowing inside of the indoor heat-exchanger, regardless of heating or cooling operation, from inside of the indoor unit to the room air suction side, which coolant circulation constitutes a reverse direction to that of the air flowing into the indoor unit, the coolant conducting arrangement comprising:

a first conduit extending from the capillary tube to the inlet for the indoor heat exchanger;

a second conduit extending from the outlet of the indoor heat exchanger to the compressor;

a first solenoid valve disposed in the first conduit;

a second solenoid valve disposed in the second conduit;

a first coolant tube having a first end thereof connected to the second conduit at a location downstream of the second solenoid valve, and a second end connected to the first conduit at a location between the first solenoid valve and the inlet of the indoor heat exchanger;

a second coolant tube having a first end thereof connected to the outlet of the indoor unit at a location upstream of the second solenoid valve, and a second end thereof connected to the first conduit at a location between the first solenoid valve and the capillary tube;

a third solenoid valve disposed in the first coolant tube between the first and second ends thereof;

a fourth solenoid valve disposed in the first coolant tube between the first and second ends thereof;

a first checking valve disposed in the first coolant tube for permitting coolant to flow only in a direction from the first end to the second end of the first coolant tube; and a second checking valve disposed in the second coolant tube for permitting coolant to flow only in a direction from the first end to the second end of the second coolant tube;

the first and second solenoid valves being open during a cooling operation and closed during a heating operation;

the third and fourth solenoid valves being open during the heating operation and closed during the cooling operation.

* * * * *